US008114355B2

(12) United States Patent
Higuchi et al.

(10) Patent No.: US 8,114,355 B2
(45) Date of Patent: Feb. 14, 2012

(54) METAL TUBE FOR PYROLYSIS REACTION

(75) Inventors: Junichi Higuchi, Nishinomiya (JP); Kenji Hamaogi, Sakae-machi (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/318,477

(22) Filed: Dec. 30, 2008

(65) Prior Publication Data

US 2009/0180935 A1 Jul. 16, 2009

Related U.S. Application Data

(63) Continuation of application No. PCT/JP2007/063357, filed on Jul. 4, 2007.

(30) Foreign Application Priority Data

Jul. 5, 2006 (JP) ..... 2006-185218

(51) Int. Cl.

| | |
|---|---|
| ***B01J 19/00*** | (2006.01) |
| *B01J 8/00* | (2006.01) |
| *B01J 10/00* | (2006.01) |
| *F28F 1/00* | (2006.01) |

(52) U.S. Cl. ..... 422/198; 422/129; 422/130; 422/600; 422/630; 422/650; 422/651; 165/177

(58) Field of Classification Search ..... 422/129, 422/130, 198, 600, 630, 650, 651; 165/133, 165/177

See application file for complete search history.

(56) References Cited

U.S. PATENT DOCUMENTS

2005/0131263 A1* 6/2005 Wolpert et al. ..... 585/652

FOREIGN PATENT DOCUMENTS

| | | |
|---|---|---|
| JP | 58-173022 | 10/1983 |
| JP | 58173022 A * | 10/1983 |
| JP | 01-127896 | 5/1989 |
| JP | 06-109392 | 4/1994 |
| JP | 08-082494 | 3/1996 |

(Continued)

OTHER PUBLICATIONS

Machine translation of JP 11-201680A, which was provided in the IDS and published on Jul. 20, 1999.*

(Continued)

*Primary Examiner* — Walter D Griffin
*Assistant Examiner* — Natasha Young
(74) *Attorney, Agent, or Firm* — Clark & Brody

(57) ABSTRACT

A metal tube in the present invention is a metal tube for pyrolysis reaction with superior characteristics of both the heat exchange and the pyrolysis reaction, which is suitable for use in a process in which hydrocarbons are pyrolytically decomposed. The tube is a metal tube for pyrolysis reaction consisting of 3 or 4 spiral ribs 1 provided on an inner surface which are inclined at 20 to 35 degrees to an axial direction of the metal tube, and characterized in that h/Di of 0.1 to 0.2 and h/w of 0.25 to 1.0 when a height of the rib 1 is defined as "h", a width of the rib 1 at its bottom part is defined as "w" and an inner diameter of the tube at the bottom part is defined as "Di" in cross section of the spiral rib 1.

2 Claims, 3 Drawing Sheets

FOREIGN PATENT DOCUMENTS

| | | | | |
|---|---|---|---|---|
| JP | 09-239563 | | | 9/1997 |
| JP | 09-241781 | | | 9/1997 |
| JP | 11-201680 | | | 7/1999 |
| JP | 2001050679 | A | * | 2/2001 |
| JP | 2005-048284 | | | 2/2005 |
| JP | 2005221153 | A | * | 8/2005 |
| JP | 2005-533917 | | | 11/2005 |

OTHER PUBLICATIONS

Machine translation of JP 2005-221153A, which was published on Aug. 18, 2005.*

Machine translation of JP 2001050679 A, which was published Feb. 23, 2001.*

* cited by examiner

METAL TUBE FOR PYROLYSIS REACTION

This application is a continuation of International Patent Application No. PCT/JP2007/063357 filed Jul. 4, 2007. This PCT application was not in English as published under PCT Article 21(2).

The disclosure of International Application No. PCT/JP2007/063357 filed Jul. 4, 2007 including specification, drawings and claims is incorporated herein by reference in its entirety.

TECHNICAL FIELD

The present invention relates to a metal tube for pyrolysis reaction, which is provided with ribs formed on the inner surface of the tube and is suitable for use as a pyrolysis furnace tube, a reforming furnace tube, a heating furnace tube, a heat exchanger tube or the like in plants such as a petroleum refinery plant, a petrochemical plant or the like. In particular, the present invention relates to a metal tube for a pyrolysis reaction which is, for example, used in an ethylene plant or the like, and more particularly relates to a metal tube suitable for use as a tube in which olefins ($C_nH_{2n}$) are produced from hydrocarbons by a pyrolysis reaction which occurs due to heat supply from the outer surface of the tube.

BACKGROUND ART

Olefins ($C_nH_{2n}$), such as ethylene ($C_2H_4$), are produced by pyrolysis of the hydrocarbons (naphtha, natural gas, ethane, or the like). In particular, to produce olefinic hydrocarbons (ethylene, propylene, or the like), the hydrocarbons are supplied with steam into a tube provided in a reacting furnace and heat is supplied to the hydrocarbons from outer surface of the tube so that a pyrolysis reaction of the hydrocarbons can be generated in the tube. The tube is made of a high-Cr and high-Ni alloy as represented by a 25% Cr-25% Ni alloy, a 25% Cr-38% Ni alloy or the like, or is made of a stainless steel as represented by AISI 304 type.

In the above described pyrolysis reaction, it is necessary to transfer heat (which is supplied to the outer surface of the tube) from the outer surface of the tube to the inner surface of the tube efficiently, so as to prevent unreacted hydrocarbons from discharging to outside of the furnace. That is, the tube needs superior "heat exchange characteristic". The heat exchange characteristic can be evaluated by measuring the average temperature of fluid at the outlet of the tube. When the tube has the superior heat exchange characteristic, the average temperature of the fluid at the outlet of the tube is increased.

A mixed gas composed of hydrocarbons and steam is supplied into a steel tube from an inlet of the steel tube with low pressure and high speed. Unreacted mixed gas and newly formed gas due to the reaction move a long distance along the ribs provided on the inner surface of the tube. Therefore, the gas flow is interrupted depending on the shape of the ribs. In this case, a fluid in the central portion of the tube and a fluid in the bottom part of the rib are separated. Thus, a mass transfer (reaction) between the central portion of the tube and the bottom part of the rib becomes insufficient. In such cases, since the reaction products are accumulated in the bottom parts of the ribs, an over pyrolysis reaction occurs. On the contrary, the reaction becomes insufficient in the center portion of the tube, leading to the yield loss. In order to solve such problems, the tube should have superior "pyrolysis reaction characteristics". The reaction characteristics can be evaluated by the deviation of temperatures at outlet of the tube, since the pyrolysis reaction characteristics depend on the mass flow in the tube.

Patent Document 1 (JP 58-173022A) discloses a production process of a tube with intratubular spiral ribs. In the above production process, the tube with intratubular spiral ribs is produced by torsional work from a metal tube with intratubular straight ribs which is produced by hot extrusion processing. Patent Document 2 (JP 01-127896A) discloses a tube material for a heat exchanger with wavy shape on the inner surface of the cross section, in which the radius of convex curvature of the crests, $R_F$, and the radius of concave curvature of the valleys, $R_S$, satisfy a relationship of $R_S \geqq R_F$.

Furthermore, Patent Document 3 (JP 08-82494A) discloses a tube for heat exchange. The tube is provided with fins which are formed on the inner surface of the tube at given pitches and extending to directions which intersect with the tube axis. In particular, the fins are arranged in one or a plurality of areas on the inner surface along the tube axis direction or in an entire area on the inner surface. Patent Document 4 (JP2005-533917A) discloses a tube with intratubular spiral fins, which is used for the pyrolysis reaction process of hydrocarbons under the existing steam.

The tubes with intratubular ribs or fins disclosed in the above described Patent Documents, however, cannot balance the "heat exchange characteristic" and the "pyrolysis reaction characteristic", and cannot improve both of the characteristics sufficiently. Thus, heat exchangeable tubes with intratubular ribs, in which both of the characteristics described above are further improved, were desired.

Meanwhile, regarding the usage conditions of metal tubes used in the pyrolysis reaction in a cracking furnace of an ethylene plant or the like, the temperature tends to become higher due to yield improvement, with a recent increase of resinoid demand. In such metal tubes used for pyrolysis reaction at higher temperatures, carbon is unavoidably formed due to the pyrolysis reaction. Then, the carbon is attached to the inner surface of the tube and deposits on the inner surface. This phenomenon is called "coking".

When coking occurs, the pyrolysis reaction efficiency decreases since the deposited carbon prevents transferring the heat supplied from the outer surface of the tube to the mixed gas. Furthermore, the steel tube becomes brittle since the accumulated carbon diffuses inside the steel tube which causes carburization of the steel tube. Thus, the damage of the steel tube is caused from the carburization portion. Moreover, when the carbon, which is flaked from the deposited layer, accumulates in the steel tube, the gas flow is interrupted and the pyrolysis reaction is inhibited as well and causes the above described damage. In addition, when the carbon deposits in large amounts, serious accidents such as an explosion or the like may take place. Therefore, a periodically flowing air and steam into the tube so as to oxidize and remove the precipitation carbon i.e. decoking is carried out in a practice. However, the decoking work leads to big problems such as a shutdown during the decoking work and an increment of man-hour or the like.

The inner surface of the metal tube for pyrolysis reaction is exposed to the carburizing gas atmosphere containing hydro carbon gas, CO gas, or the like. Therefore, a heat resistant material having resistances to carburization and coking in the carburizing gas atmosphere is required as a tube material.

Patent Document 5 (JP 2005-48284A) discloses a stainless steel tube that consists of a mother material including 20 to 35 mass % Cr and the tube has resistances to carburization and coking. The disclosed tube has a surface layer comprised of a Cr-depleted layer that includes more than or equal to 10 mass % Cr and which thickness is less than or equal to 20 μm. Although it is disclosed that protrusion, fin or the like may be provided on the inner surface of the tube in the Patent Document 5, the specific configurations are not disclosed at all.

[Patent Document 1] JP 58-173022A
[Patent Document 2] JP 01-127896A
[Patent Document 3] JP 08-82494A
[Patent Document 4] JP2005-533917A
[Patent Document 5] JP 2005-48284A

DISCLOSURE OF THE INVENTION

[Subject to be Solved by the Invention]

The present invention has been achieved in view of actual situations described above, and an object of the present invention is to provide a metal tube for pyrolysis reaction which has both characteristics (1) and (2) described below.

(1) High pyrolysis reaction characteristic which is achieved with frequent contact of the unreacted gas in the center portion of the tube axis to the inner surface (which is reaction site) of the tube.

(2) Superior characteristic for pyrolysis reaction, heat exchange and resistance to carburization, which is suitable for use in the process for pyrolytically decomposing hydrocarbons.

[Means to Solve the Problems]

In order to solve the above described subjects, the present inventors investigated widely in order to provide a metal tube for pyrolysis reaction, which accelerates the pyrolysis reaction by increasing frequent contact with the unreacted gas in the center portion of the tube axis to the inner surface (which is the reaction site) of the tube and has superior characteristic of heat exchanging and superior resistance to carburization. Consequently, the inventors obtained the findings (A) to (E) described below.

(A) In order to prevent unreacted hydrocarbons from discharging to outside of a furnace, it is necessary to efficiently transfer heat (which is supplied to the outer surface of a tube) from the outer surface of the tube to the inner surface of the tube. That is, it is necessary that the heat exchange characteristic of the tube is superior. For this purpose, a contact area between flowing gas in the tube and the inner surface of the tube, or an area of the inner surface of the tube should be large.

(B) The area of the inner surface of the tube increases with increasing the number of intratubular ribs. Also the area of the inner surface increases with increasing the rib height. Furthermore, the area of the inner surface increases more when the ribs are raised at a sharp angle on the cross section than when the concavo-convex shape, which curves gently on cross section, is formed by the ribs.

The heat exchange characteristic, when heating outside of the tube, is improved if the ribs have a sharp shape. Since the total area of thinner parts of the tube, or the total area of the bottom parts of the ribs is large when the ribs have a sharp shape, the heat exchange characteristic is improved. However, the high ribs may expand the distance from the tops of the ribs to outer surface of the tube. In this case, since a thickness of the tube, measured at the top of the rib, is increased, a heat transfer from the outside of the tube becomes insufficient. Thus, the temperature at the top of the rib decreases. As a result of foregoing, the heat exchange characteristic deteriorates.

(C) A mixed gas composed of hydrocarbons and steam is supplied into the tube from the inlet of the tube with low pressure and high speed. The gas, which is formed from the mixed gas by the reaction, moves a long distance along the ribs provided on the inner surface of the tube. Here, the gas flow is interrupted depending on the shapes of the ribs or the number of the ribs. In this case, since a velocity deviation between a fluid in the central portion of the tube and a fluid in the bottom part of the tube becomes excessive, and a mass transfer (reaction) between the central portion of the tube and the bottom part of the rib becomes insufficient. In such cases, since the reaction products accumulate in the bottom parts of the ribs, over pyrolysis reaction occurs. On the contrary, the reaction becomes insufficient in the center portion of the tube, leading to the yield loss. Therefore, it is necessary to reduce the accumulation of the gas on the inner surface of the tube and also to uniformize the gas flow on cross section. That is, it is necessary to improve the pyrolysis reaction characteristics.

(D) The pyrolysis reaction characteristics of the tube are improved by increasing the rib height, or by increasing the inclination angle of the spiral rib to the tube axis. When the rib height is too high or the inclination of the spiral rib is too large, however, the fluid flow is interrupted at the bottom part by the rib. In this case, a fluid in the central portion of the tube and the fluid in the bottom part of the rib are separated, leading to an increase of velocity deviation of the fluid. Consequently, the pyrolysis reaction characteristics of the tube are deteriorated. Furthermore, when the number of ribs is increased, the fluid flow is interrupted at the bottom part by the rib. In this case, since the fluid flow which passes between the bottom part and the central portion of the tube becomes stagnant, the fluid in the central portion of the tube and a fluid in the bottom part of the rib are separated. Consequently, the pyrolysis reaction characteristics of the tube deteriorate.

(E) For the above described reasons, it is necessary to optimally determine the number of the ribs formed on the inner surface of the tube, the rib height, the inclination angle of the rib to the tube axis, and the like in order to achieve a balance between the heat exchange characteristic and the pyrolysis reaction characteristic.

The present invention has been completed based on of the above described findings, and the gists of the present invention is a metal tube for pyrolysis reaction, described in following (1) to (4).

(1) A metal tube for pyrolysis reaction comprising 3 or 4 spiral ribs, which have 20 to 35 degrees inclination to an axial direction of the metal tube, provided on an inner surface of the metal tube; characterized in that h/Di of 0.1 to 0.2 and h/w of 0.25 to 1.0when a height of the each spiral rib is defined as "h", a width of the each spiral rib at its bottom part is defined as "w" and an inner diameter of the metal tube at the bottom part is defined as "Di" in cross section of the each spiral rib.

Note that "cross section of the each spiral rib" means a cross section perpendicular to an axis of the metal tube.

(2) The metal tube for pyrolysis reaction according to the above described (1), characterized in that a cross-section shape of the each rib is isosceles triangular.

(3) The metal tube for pyrolysis reaction according to the above described (1) or (2), characterized in that the spiral ribs are integrally-formed with a tube body by hot extrusion (4) The metal tube for a pyrolysis reaction according to any of the above described (1) to (3), characterized in that the metal tube is a tube which is used for a pyrolysis reaction process of hydrocarbons.

Various shapes such as a triangular shape, a trapezoidal shape or the like can be employed to the cross section shape of the tube of the present invention. An isosceles triangular shape is desirable among the triangular shapes. An isosceles trapezoid shape is desirable among the trapezoid shapes. In case of the trapezoid shape, a longer side among two parallel sides is arranged on the bottom side.

FIG. 1 is a figure which explains the rib shape of the metal tube of the present invention, which shows a part of the cross section perpendicular to the tube axis. As shown in the figure, a rib 1 is provided on an inner surface of the tube. The rib shape, shown here as an example, is an isosceles triangular shape. In the figure, a rib height is indicated by "h" and a rib width at the bottom part is indicated by "w". A bottom inner diameter "Di" of the rib is an inner diameter of the tube corresponding to the bottom part of the rib, and a mount inner diameter "Dm" of the rib is an inner diameter of the tube corresponding to a top of the rib. Note that the "isosceles triangular shape" means a substantially isosceles triangular shape as described below.

As described above, various shapes such as a triangular shape, a trapezoidal shape and the like can be employed to the cross section shape of the tube of the present invention. Here, the triangular shape includes not only a proper triangular shape but also a shape which is substantially considered as a triangular shape. Moreover, the trapezoidal shape includes not only a proper trapezoidal shape but also a shape which is substantially considered as a trapezoidal shape. For example, the rib may have rounded top as shown in FIG. 1. This is same in the case of trapezoidal shape. The corner of parallel side and oblique side may have rounded shape such as chamfered shape. Furthermore, the oblique side between the top of the rib and the bottom part of the rib may not always be a straight line. Especially, it is desirable that the oblique side and the bottom part of the rib are connected by a smooth curve.

As described above, an isosceles triangular shape is desirable among the triangular shapes and an isosceles trapezoid shape is desirable among the trapezoid shapes. The tube with ribs, each of which is a continuous protrusion provided on the inner surface of the tube, can be easily produced by a hot working process or a cold working process when the rib shape is bilaterally symmetric as described above.

[Efficacy of the Invention]

The metal tube in the present invention is a metal tube for a pyrolysis reaction which has a superior heat exchange characteristic and a superior pyrolysis reaction characteristic. By using this tube, the production yield of olefins such as hydrocarbons can be improved with low energy. In addition, since this tube has superior resistances to carburization and coking, the operation rate of the production apparatus can be improved.

BEST EMBODIMENT OF THE INVENTION

1. On the Shape of Ribs

In order to optimize the rib shape, the following simulation test has been conducted.

1-1. Simulation Test 1

As shown in Table 1, metal tubes for pyrolysis reaction with various kinds of intratubular ribs with varying numbers, height, shape and inclination angles were prepared, and the simulation test was conducted using the condition shown in Table 2.

[Table 1]

TABLE 1

| | |
|---|---|
| Tube length | 4000 mm |
| Outer diameter of the tube, $D_O$ | 61 mm |
| Inner diameter at the rib bottom, $D_i$ | 48 mm |
| Inner diameter at the top of the rib, $D_m$ | 37 mm |
| Number of ribs | 1, 2, 3, 4, 5, 8 |
| Inclination angle of the rib (degree) | 15°, 20°, 25°, 30°, 35° |
| Rib dimension | Height, h: 5.5 mm<br>Width at the bottom, w: 13.7 mm |

[Table 2]

TABLE 2

| | |
|---|---|
| Supplied fluid | Air |
| Flowing rate | 50 m/sec |
| Temperature of the fluid supplied to the inside of the tube | 293 K |
| Temperature of the outer surface of the tube | 1123 K |
| Others | The region of 1 m in the fluid inlet side is entrance region. The region of 3 m in the rear side is heating region. |

In this simulation, the equations of mass conservation, moment conservation and energy conservation of fluid in the steel tube were solved based on the conditions shown in Table 2 without considering the pyrolysis reaction by using a commercial computational fluid dynamics code. Then, the flow and the thermal conductive behavior in the steel tube were evaluated by the three dimensional simulation so as to calculate an effective viscosity coefficient (an effective thermal conductivity and an effective diffusion coefficient) in the tube. Note that, the turbulent model was employed in order to consider the effect of turbulent flow. The results obtained are shown in FIG. 2.

Figure 1:
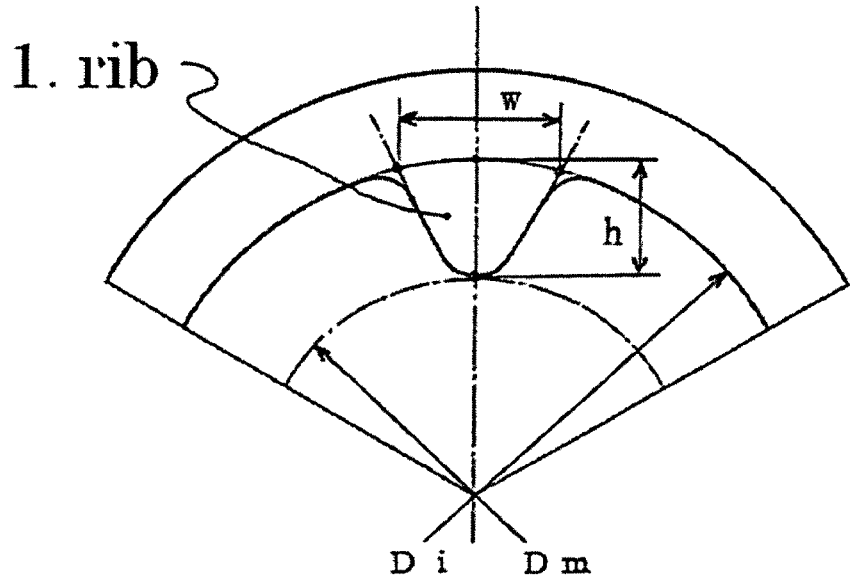
FIG. 1 is a figure which explains the rib shape of the metal tube of the present invention, which shows a part of the cross section perpendicular to the tube axis.
Figure 2:
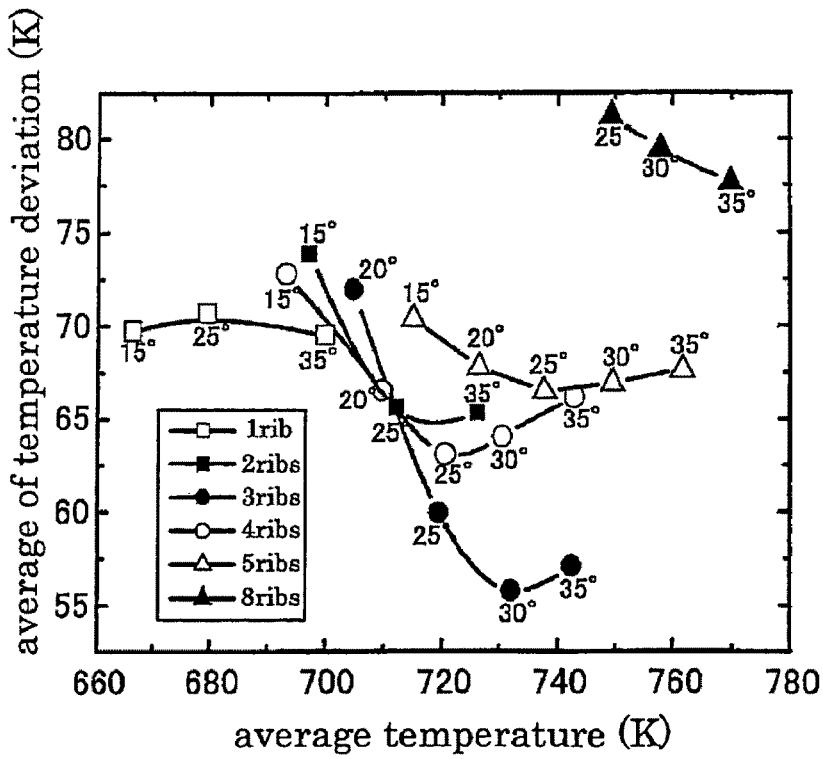
FIG. 2 illustrates the average temperature and the temperature deviation of fluid at the outlet of the metal tubes having various numbers of ribs and various inclination angles.

In FIG. 2, a horizontal axis means the average temperature of the fluid at the outlet of the steel tube. Higher value of this average temperature means high heat transfer ability from the outside of the steel tube, showing good heat exchange performance.

A vertical axis in FIG. 2 shows an average of temperature deviation of the fluid at the outlet of the steel tube. Lower value of the average of temperature deviation means that the temperature is distributed uniformly in the cross section of the steel tube. In other words, when the value of the average of temperature deviation is large, the temperature in the center portion of the steel tube is low, and the portion near the inner surface is locally heated, showing poor performance of the pyrolysis reaction.

A value of the vertical axis in FIG. 2 (average of temperature deviation) is equal to the value of ΔT which is obtained by following formula 1, when the average temperature is defined as "$T_{mean}$(K)", and a local temperature in the same cross section is defined as "$T_{local}$(K)". Note that, "S" indicates a cross section area of a space in which the fluid passes through in the tube.

$$\Delta T = \frac{1}{S}\int_S \sqrt{(T_{local} - T_{mean})^2}\, dS \qquad \text{[Formula 1]}$$

From FIG. 2, the following conclusion can be obtained.

1) The heat exchange performance, represented by the average temperature of the fluid at the outlet of the tube (horizontal axis in FIG. 2), is increased by increasing an area of the inner surface of the tube. The area of the inner surface of the tube is increased by increasing a number of ribs.

2) The average of temperature deviation at the tube outlet ("ΔT" calculated by the above formula 1), is decreased by increasing the inclination angle of the rib. That is, the characteristic of the pyrolysis reaction is improved by increasing the inclination angle of the rib. At the same inclination angle, when the number of ribs is 3, the pyrolysis reaction represents maximum performance. When the rib numbers are arranged in descending order of the pyrolysis reaction performance, it is arranged in order of three ribs, four ribs, two ribs, five ribs, one rib and eight ribs.

1-2. Simulation Test 2

Figure 3:
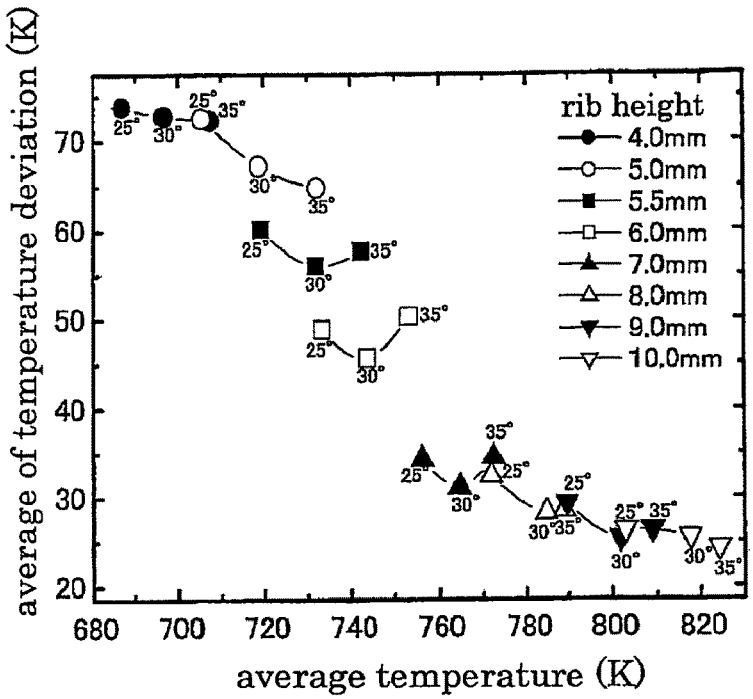
FIG. 3 illustrates the effects of rib height and inclination angle of the rib on the average temperature and the temperature deviation of fluid at the outlet of the tubes.

As shown in Table 3, the effect of the rib shape was investigated by the simulation test under the same condition as in Table 2, using tubes with 3 ribs of various heights and various inclination angles. The results are shown in FIG. 3.

[Table 3]

Figure 4:
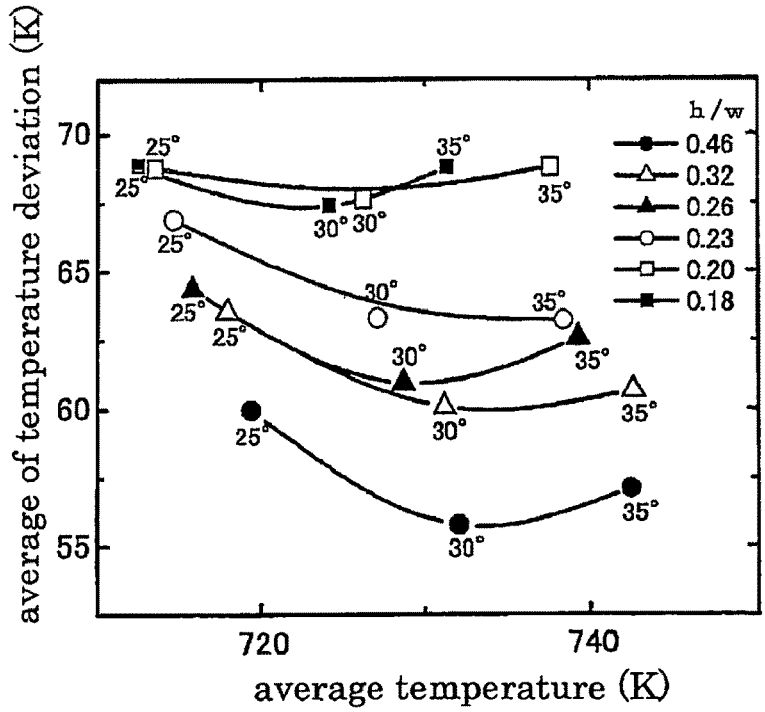
FIG. 4 illustrates effects of h/w, the ratio of rib height "h" and rib width "w" at the bottom, and the inclination angle of the rib on average temperature and temperature deviation of fluid at the outlet of the tubes.

As is obvious from FIG. 4, the performance of the pyrolysis reaction is deteriorated by decreasing "h/w", where the rib shapes becomes rather smooth wave. That is, the average of temperature deviation indicated by the vertical axis of FIGS. 2 to 4 increases with decreasing the "h/w". On the contrary, the performance of pyrolysis reaction is improved by increasing the h/w. When the h/w is small, the area of the inner surface becomes small compared to when the h/w is large with sharp shape of rib. Therefore, the average temperature indicated by the horizontal axis of FIGS. 2 to 4 is decreased. That is, the heat exchange performance has a tendency to be lowered.

TABLE 3

| | | | | | | | | | |
|---|---|---|---|---|---|---|---|---|---|
| Tube length | | 4000 mm | | | | | | | |
| Outer diameter of the tube, $D_O$ | | 61 mm | | | | | | | |
| Inner diameter at the rib bottom, $D_i$ | | 48 mm | | | | | | | |
| Inner diameter at the top of the rib, $D_m$ | | 37 mm | | | | | | | |
| Number of ribs | | 3 | | | | | | | |
| Inclination angle of the rib (degree) | | 25°, 30°, 35° | | | | | | | |
| Rib dimension | Height, h(mm) | 4.0 | 5.0 | 5.5 | 6.0 | 7.0 | 8.0 | 9.0 | 10.0 |
| | h/Di | 0.083 | 0.104 | 0.115 | 0.125 | 0.146 | 0.167 | 0.188 | 0.208 |
| | Width at the bottom, w (mm) | 14.5 | 14.1 | 13.7 | 13.3 | 13.0 | 12.7 | 12.2 | 11.9 |

As is obvious from FIG. 3, by increasing the rib height, the average temperature indicated by the horizontal axis is increased, i.e., the heat exchange performance is improved. Also, by increasing the rib height, the average of temperature deviation indicated by the vertical axis is decreased, i.e., the performance of the pyrolysis reaction is improved. When the rib height is 4.0 mm, however, performance of the pyrolysis reaction is deteriorated. On the contrary, the performance of the pyrolysis reaction at rib height of 10.0 mm shows a small advantage, compared to those at the rib height of 8.0 mm or 9.0 mm. There is so not much difference in the effect of the inclination angle of the rib between 25° to 35°.

As described above, the characteristics of both heat exchange and pyrolyric reaction are improved by increasing the rib height (h). When the rib height is too high, however, the gas flow is interrupted by the rib. Thus, the gas is stagnated at the bottom part, leading to deterioration of the pyrolysis reaction performance. Also, the temperature at the top portion of the rib becomes lower, leading to a deterioration of the heat exchange characteristics. Furthermore, it becomes easy to introduce coking and also makes it difficult to form high ribs by hot extrusion or cold rolling. Meanwhile, when the rib height is too low, the area of the inner surface of the tube becomes smaller leading to deterioration of the heat exchange characteristic and pylorisis reaction performance.

1-3. Simulation Test 3

As shown in Table 4, a simulation test under the same conditions as in Table 2 was conducted, using tubes with 3 ribs of 5.5 mm height with various rib width "w", for the different inclination angles of 25°, 30° and 35°. The results are shown in FIG. 4.

[Table 4]

From a view point of the manufacturing process of the tubes, it becomes difficult to produce such tubes with high and thin ribs, i.e., high value of h/w, by hot extrusion or cold rolling.

1-4. Decision of the Optimum Shape Ribs on the Basis of Simulation Tests (1) Number of Ribs From the results of the simulation test 1, a suitable rib number was determined to be 3 or 4. Desirable rib number is 3.

(2) Inclination Angle of Rib

From the results of simulation test 1, the inclination angle of the rib was determined to be 20° to 35°. A favorable angle is 25° to 30°.

(3) Shape of ribs (relation among rib height "h", rib width on the bottom "w", and an inner diameter at the rib bottom "Di")

Suitable h/Di and h/w were determined to be 0.1 to 0.2, and 0.25 to 1.0, respectively, where h: rib height in the transverse cross section of the tube, w: rib width at the bottom, and Di: inner diameter at the rib bottom.

Rib height "h" was determined to be represented by h/Di. Although various size tubes are used for a metal tube in the pyrolysis reaction, it can be considered that a figure is a similar figure when the heat exchange and the pyrolysis reaction on the inner surface of the tube are considered. Therefore, the rib height "h" can be normalized by h/Di. As shown in FIG. 3, results of simulation test 2, both performances of heat exchange and pyrolysis reaction are improved by increasing the rib height "h" to above or equal to 5.0 mm, and the improvement becomes evident when the rib is higher. Although the heat exchange performance is improved by increasing the rib height, the improvement effect on pyrolysis

TABLE 4

| | | | | | | | |
|---|---|---|---|---|---|---|---|
| Tube length | | 4000 mm | | | | | |
| Outer diameter of the tube, $D_O$ | | 61 mm | | | | | |
| Inner diameter at the rib bottom, $D_i$ | | 48 mm | | | | | |
| Inner diameter at the top of the rib, $D_m$ | | 37 mm | | | | | |
| Number of ribs | | 3 | | | | | |
| Inclination angle of the rib (degree) | | 25°, 30°, 35° | | | | | |
| Rib dimension | Height, h(mm) | 5.5 | | | | | |
| | Width at the bottom, w (mm) | 12 | 17 | 21 | 24 | 28 | 31 |
| | h/w | 0.46 | 0.32 | 0.26 | 0.23 | 0.20 | 0.18 |

reaction performance is saturated when the rib height is 8.0 to 10.0 mm. From the view point of tube manufacturing, tubes with lower height ribs are desirable because of the easier rib forming. From the above described reasons, the favorable rib height "h" was determined to be 5.0 to 10.0 mm, and a suitable range of h/Di was determined to be 0.1 to 0.2 because the inner diameter at the bottom part "Di" of the tube used in the simulation test 2 is 48 mm. The upper limit rib height is favorably 8 mm since the improvement effect of increasing rib height on the pyrolysis reaction is saturated, in addition to the tube manufacturing concern, i.e., tubes with ribs becomes difficult to produce by hot or cold working. Therefore a further desirable upper limit of h/Di is 0.17.

Next, the relation between the rib height "h" and the rib width at the bottom "w" will be described as following.

Considering the heat exchange characteristics and pyrolysis reaction performance (fluid flow between the rib bottom and the center portion of the tube), while also considering the workability during rib forming, the rib shape should be characterized not only by rib height "h" but also by the ratio between the rib height "h" and the rib width at the bottom "w" (which is h/w). It can be clearly seen from the results of simulation test 3, with the decreasing h/w, the average of temperature deviation is increased, and the performance of pyrolysis reaction is deteriorated. From such results, the lower limit of h/w was determined to be 0.25. On the contrary, since pyrolysis reaction performance is improved by increasing the h/w, the h/w should favorably be large. Therefore, the favorable lower limit is 0.35, and more favorable lower limit is 0.4.

On the other hand, although the maximum value of h/w in the simulation test 3 was 0.46, if h/w is increased, the performances of both pyrolysis reaction (average of temperature deviation) and heat exchange (average temperature) have a tendency to improve. Also, although the h/w was not changed linearly in the simulation test 2 using tubes with various rib height "h", as can be seen from the values of rib height "h", and rib width at the bottom "w", in Table 3, h/w was changed from 0.28 to 0.84, and performance of both pyrolysis reaction (average of temperature deviation) and heat exchange (average temperature) were improved by increasing the h/w as shown in FIG. 4. From the above described reasons, the upper limit of h/w has been determined to be 1.0, the favorable upper limit is 0.7, and more favorable upper limit is 0.55.

2. Production Process of a Metal Tube in the Present Invention

The metal tube for pyrolysis reaction in the present invention is produced from pipe shape materials, such as seamless pipe, welded pipe, or the like, which are prepared by combining the processes of melting, casting, hot working, cold working, welding, or the like. Of course, pipe shape materials may be prepared by means of powder metallurgy, centrifugal casting, or the like.

As a method to form spiral ribs on the inner surface of the tube, following methods of (a)-(c) are shown by the following example.

(a) First, a tube with intratubular straight ribs, in which rib height is uniform in the longitudinal direction of the tube, is produced by using a hot exclusion piping press or a cold rolling with a mandrel having an outer surface in which convex portions corresponding to the bottom parts of the tube and concave portions corresponding to the ribs of the tube are formed along a direction parallel to the axis of the mandrel. Next, torsional work is added to the tube with intratubular straight ribs, resulting in tubes with intratubular spiral ribs.

(b) A tube with intratubular spiral ribs, in which rib height is uniform in the longitudinal direction of the tube, is produced by using a cold drawing type piping machine with a plug having an outer surface in which convex portions corresponding to the bottom parts of the tube and concave portions corresponding to the ribs of the tube are formed in a spiral manner.

(c) A tube with intratubular spiral ribs is produced by deposit welding to form ribs on the inner surface of the tube.

Among the above described methods, the production method, in which spiral ribs are formed by the torsional work after forming the ribs by the hot exclusion, enables to produce long products compared to a case when the tube is produced by the powder metallurgy or the centrifugal casting, or a case when the ribs are produced by the deposit welding. In this method, it is not necessary to connect a tube with another tube by welding even when a tube longer than 10 m is needed to produce. In addition, since the tube produced by this method consists of the same material in a rib part and a mother tube, the tube has an advantage of much better properties, such as corrosion resistance, high temperature strength, or the like compared to the tube with intratubular ribs produced by deposit welding using different materials. Furthermore, the tube is suitable for usage requiring high temperature strength, resistance to corrosion, or resistance to carburization, for example, in a pyrolysis reaction of hydrocarbons, or the like.

In the method of the forming ribs by the hot extrusion, if the rib height is too high, the ribs may be extruded not sufficiently along the mandrel shape. Thus, given height of the rib cannot be obtained in some part. Therefore, in the hot extrusion method, the rib shape to be formed is limited, and too high ribs are not desirable.

3. Material of a Tube

When the superior resistance to carburization or coking is strongly required, a tube with following chemical composition, having good high temperature strength and enough hot workability, in addition to superior resistances to carburization and coking, is favorable. Note that, "%", regarding the component content, means "mass %".

(1) A metal tube having a chemical composition consisting of, C: 0.01 to 0.6%, Si: 0.01 to 5%, Mn: 0.1 to 10%, P: less than or equal to 0.08%, S: less than or equal to 0.05%, Cr: 15 to 55%, Ni: 20 to 70%, N: 0.001 to 0.25%, and balance Fe and impurities.

(2) A metal tube further consisting of at least one or more elements selected from at least one or more groups selected from (i) to (vi) in addition to the above described chemical components.

(i) One or two elements selected from Cu: 0.01 to 5% and Co: 0.01 to 5%.

(ii) One or more elements selected from Mo: 0.01 to 3%, W: 0.01 to 6% and Ta: 0.01 to 6%.

(iii) One or two elements selected from Ti: 0.01 to 1% and Nb: 0.01 to 2%.

(iv) One or more elements selected from B: 0.001 to 0.1%, Zr: 0.001 to 0.1% and Hf: 0.001 to 0.5%.

(v) One or more elements selected from Mg: 0.0005 to 0.1%, Ca: 0.0005 to 0.1% and Al: 0.001 to 5%.

(vi) One or more elements selected from rare earth elements (REM) of 0.0005 to 0.15%.

Efficacy of above described chemical composition of each element is described below, with their limitation reasons.

C: 0.01 to 0.6%

C is an effective element for keeping high temperature strength, when the content is more than or equal to 0.01%. On the contrary, since toughness is markedly deteriorated by addition of more than 0.6%, the upper limit is 0.6%. Favorable content is 0.02% to 0.45%, and more favorable content region is 0.02% to 0.3%.

Si: 0.01 to 5%

Si is needed as a deoxidizing element. In addition, Si is an effective element to improve resistances to oxidation and carburization. In order to obtain this effect, a content of not less than 0.01% is needed. However, by the addition of more than 5%, weldability is deteriorated, and microstructure is unstable, thus the upper limit is 5%. Favorable content is 0.1 to 3%, and most favorable region is 0.3 to 2%.

Mn: 0.1 to 10%

Mn is added in order to improve workability, in addition to the role of a deoxidizer. In order to obtain this effects, a content of more than or equal to 0.1% is needed. Furthermore, since Mn is an austenite forming element, a part of Ni can be replaced by Mn. However, an excessive addition of Mn leads to deterioration of workability. Thus, the upper limit is 10%. Favorable content is 0.1 to 5%, and most favorable region is 0.1 to 2%.

P: less than or equal to 0.08%, S: less than or equal to 0.05%

P and S deteriorates hot workability by their segregation to the grain boundaries, and favorably the contents should be decreased as low as possible. However, excessive lowering of the P and S contents increases cost in the production process. Therefore, the content of P is less than or equal to 0.08% and the content of S is less than or equal to 0.05%. Favorably P and S contents should be less than or equal to 0.05% and 0.03%, respectively. More favorably, P and S contents should be less than or equal to 0.04% and 0.015%, respectively.

Cr: 15 to 55%

Cr is an essential element to obtain oxidation resistance, and a content of more than or equal to 15% is needed. Although the content of Cr should favorably be increased as high as possible, from the view points of oxidation resistance and carburizing resistance, excessive addition leads to workability deterioration or to unstable microstructure during the use at high temperatures. Thus, the upper limit is 55%. In order to prevent the above described disadvantages of workability deterioration and unstable microstructure at high temperatures, the upper limit should favorably be 35%. More favorably, the content region is 20 to 33%.

Ni: 20 to 70%

Ni is needed to obtain the stable austenitic microstructure, a content of 20 to 70% is necessary corresponding to the content of Cr. However, since excessive addition leads to problems in the manufacturing process and increases cost, the favorable region is 20 to 60%, and most favorable region is 23 to 50%.

N: 0.001 to 0.25%

Ni is an effective element for the improvement of high temperature strength. In order to achieve this effect, a content of more than or equal to 0.001% is needed. On the contrary, since excessive addition significantly deteriorates the workability, the upper limit is regulated to be 0.25%. Favorable content of N is 0.001 to 0.2%.

In the present invention, one or more elements shown below may be contained.

One or two elements selected from Cu: 0.01 to 5% and Co: 0.01 to 5%

Copper and Co as an austenite stabilizer improves high temperature strength, and each element of more than or equal to 0.01% may be contained. On the contrary, when the content of each element exceeds 5%, hot workability is markedly deteriorated. Therefore, the content region of each element is regulated to be 0.01 to 5%. Favorable region for each element is 0.01 to 3%.

One or more elements selected from Mo: 0.01 to 3%, W: 0.01 to 6% and Ta: 0.01 to 6%

Mo, W and Ta are effective elements as the solid solution strengthening elements for improving the high temperature strength, and the effect can be obtained when the content of each element is more than or equal to 0.01%. However, since excessive addition leads to deteriorations in workability and in microstructure stability at high temperatures, Mo, W and Ta should be controlled to be less than or equal to 3%, 6% and 6%, respectively. Favorable content region of each Mo, W and Ta is 0.01 to 2.5%, and more favorably 0.01 to 2%.

One or two elements selected from Ti: 0.01 to 1% and Nb: 0.01 to 2%

Ti and Nb are useful elements for marked improvement effects in high temperature strength, ductility and toughness, even with a small additional amount. These effects cannot be obtained when the content of each element is less than 0.01%. Further, when a content of Ti is more than 1% or when a content of Nb is more than 2%, the workability or the weldability is deteriorated.

One or more elements selected from B: 0.001 to 0.1%, Zr: 0.001 to 0.1% and Hf: 0.001 to 0.5%

B, Zr and Hf are effective elements to strengthen the grain boundary and to improve hot workability and high temperature strength. However, the effects cannot be obtained when the content of each element is less than 0.001%. On the contrary, since excessive addition leads to deterioration in weldability, the contents of B, Zr and Hf are regulated to be 0.001 to 0.1%, 0.001 to 0.1% and 0.001 to 0.5%, respectively.

One or more elements selected from Mg: 0.0005 to 0.1%, Ca: 0.0005 to 0.1% and Al: 0.001 to 5%

Each element of Mg, Ca and Al is effective for improving the hot workability, and the effect can be obtained when each content of Mg, Ca and Al is more than or equal to 0.0005%, 0.0005% and 0.001%, respectively. In addition Al can introduce marked improvement effect for carburization resistance of a metal tube, since oxidized scale consisting mainly of Cr and Al is formed under the carburizing circumstances. For this purpose, the Al addition of more than or equal to 1.5% is effective. On the contrary, the excessive addition of Mg and Ca deteriorates weldability, thus the upper limit of each element is regulated to be 0.1%. Furthermore, the excessive addition of Al of more than 5% introduces intermetallic compound formation within the alloy, leading to deteriorations in toughness or in creep ductility.

Favorable content region of Mg and Ca is 0.0008 to 0.05%, and favorable Al content for improving carburization resistance is 2 to 4%.

One or more elements selected from rare earth elements (REM) of 0.0005 to 0.15%

Rare earth elements are effective for improving the oxidization resistance, but the effect cannot be obtained when a content of each element is less than 0.0005%. On the contrary, since excessive addition leads to deterioration in workability, the upper limit of the content is regulated to be 0.15%. Note that, REM is a collective term showing 17 kind elements including Sc, Y and 15 elements of lanthanoid. Among them, one or more elements selected from Y, La, Ce and Nd should favorably be used.

4. Example of Producing a Tube with Intratubular Ribs

Figure 5:
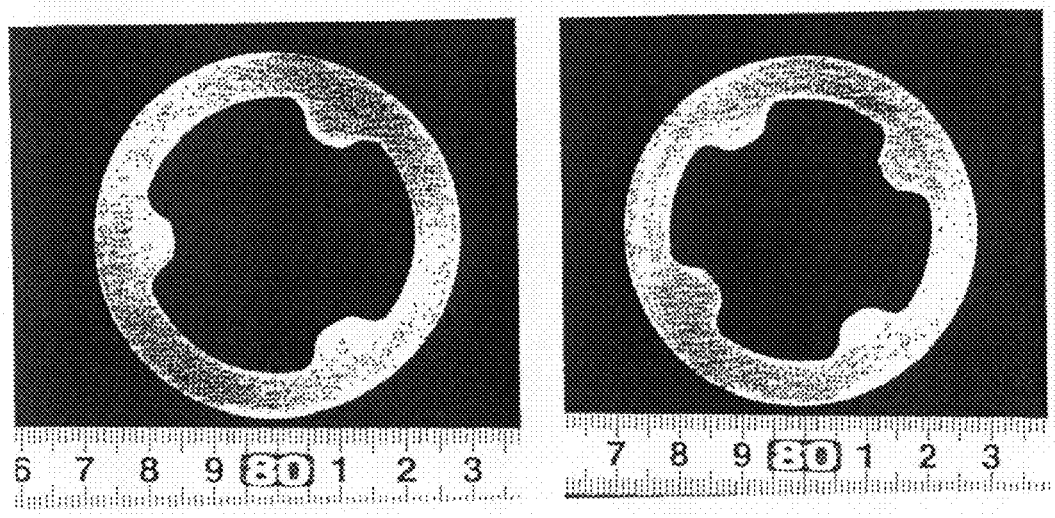
FIG. 5 illustrates copies of photographs, showing the cross section perpendicular to the tube axis of tubes.

A tube with 3 straight ribs on its inner surface and a tube with 4 straight ribs on its inner surface are produced from hollow billets having chemical compositions shown in Table 5 by hot extruding using the mandrel provided with concavo-convex corresponding to the shape of ribs. After softening heat treatment of the tubes at 1150° C., the tubes were torsionally deformed by an inclination angle of 27° from the tube axis, and finally the tubes are treated with product processing in which the tubes are cooled in water after heating treatment of 1230° C. for 3 minutes. Consequently, the tubes with spiral ribs having dimensions shown in Table 6 are obtained FIG. 5 illustrates copies of photographs, showing the cross section of the tubes. As shown in the figure, chipping on the top of ribs or cracking at rib bottom has never been seen.

[Table 5]

TABLE 5

| (Chemical composition of a steel specimen. mass %, Balance: Fe and impurities.) | | | | | | | | | | | |
|---|---|---|---|---|---|---|---|---|---|---|---|
| C | Si | Mn | P | S | Cr | Ni | Mo | Ti | B | Al | N |
| 0.11 | 1.45 | 0.38 | 0.014 | 0.0003 | 23.9 | 38.3 | 1.05 | 0.45 | 0.0021 | 0.017 | 0.0112 |

[Table 6]

TABLE 6

| | | |
|---|---|---|
| Tube length | 10000 mm | |
| Outer diameter of the tube, $D_O$ | 56.6 mm | |
| Inner diameter at the rib bottom, $D_i$ | 44.6 mm | |
| Inner diameter at the top of the rib, $D_m$ | 34.4 mm | |
| Number of ribs | 3 | 4 |
| Inclination angle of the rib (degree) | 27° | 27° |
| Rib dimension | Height, h: 5.5 mm Width at the bottom, w: 12.5 mm | Height, h: 5.5 mm Width at the bottom, w: 12.5 mm |

INDUSTRIAL APPLICABILITY

A metal tube for pyrolysis reaction in the present invention can improve the production yield of olefins such as hydrocarbons with low energy because of superior characteristics of both the heat exchange and the pyrolysis reaction. Furthermore, the metal tube in the present invention can improve the operation rate of the production apparatus because of good resistance to coking. Thus, the metal tube in the present invention can be used not only for producing olefins such as ethylene, but also as a metal tube for pyrolysis reaction using for various kinds of pyrolysis reaction.

The invention claimed is:

1. A metal tube for pyrolysis reaction comprising 3 or 4 spiral ribs, which have 20 to 35 degrees inclination to an axial direction of the metal tube, provided on an inner surface of the metal tube; characterized in that h is 5.0 to 9.0 mm and h/w of 0.25 to 0.46 when a height of the each spiral rib is defined as "h" and a width of the each spiral rib at its bottom part is defined as "w" in cross section perpendicular to the tube axis, wherein a cross-section shape of each rib is an isosceles triangle and the spiral ribs are integrally-formed with a tube body by hot extrusion.

2. The metal tube for a pyrolysis reaction according to claim 1, characterized in that the metal tube is a tube which is used for a pyrolysis reaction process of hydrocarbons.

* * * * *